US007606648B2

(12) United States Patent
Shepherd et al.

(10) Patent No.: US 7,606,648 B2
(45) Date of Patent: Oct. 20, 2009

(54) OPERATOR DISPLAY SYSTEM

(75) Inventors: John Shepherd, Stafford (GB); Mark Lewis Whatley, Worcestershire (GB)

(73) Assignee: J. C. Bamford Excavators Limited, Rocester, Uttoxeter, Staffordshire (GB)

( * ) Notice: Subject to any disclaimer, the term of this patent is extended or adjusted under 35 U.S.C. 154(b) by 777 days.

(21) Appl. No.: 11/125,936

(22) Filed: May 10, 2005

(65) Prior Publication Data

US 2005/0256607 A1 Nov. 17, 2005

(30) Foreign Application Priority Data

May 11, 2004 (GB) ..... 0410415.4

(51) Int. Cl.
*G06F 7/70* (2006.01)
*G06G 7/00* (2006.01)

(52) U.S. Cl. ..... 701/50; 91/522; 250/231; 296/199.01; 296/190.08; 180/89.12; 37/379

(58) Field of Classification Search ..... 701/50; 296/190.01, 70, 190.08; 180/89.12; 37/379; 414/266; 91/522; 250/231
See application file for complete search history.

(56) References Cited

U.S. PATENT DOCUMENTS 4,832,287 A * 5/1989 Werjefelt ..... 244/118.5
4,949,263 A * 8/1990 Jurca ..... 701/50
4,994,973 A * 2/1991 Makino et al. ..... 701/50
5,072,218 A * 12/1991 Spero et al. ..... 340/980
5,455,591 A * 10/1995 Hui ..... 342/185
5,673,963 A 10/1997 Pietzsch ..... 296/190
5,811,055 A * 9/1998 Geiger ..... 266/49
6,014,117 A * 1/2000 Hennessy et al. ..... 345/8
6,034,653 A * 3/2000 Robertson et al. ..... 345/8
6,128,109 A * 10/2000 Jenkins et al. ..... 359/11
6,208,933 B1 * 3/2001 Lazar ..... 701/207
6,233,748 B1 * 5/2001 Gieger et al. ..... 2/410
6,371,232 B1 * 4/2002 Drake et al. ..... 180/89.12
6,536,553 B1 * 3/2003 Scanlon ..... 181/108

(Continued)

FOREIGN PATENT DOCUMENTS

DE 10339050 A1 * 3/2005

(Continued)

OTHER PUBLICATIONS

James E. Melzer and Kirk Moffitt, "Head-Mounted Displays Designing for the User," McGraw-Hill, 1997, pp. 5-8; p. 56; p. 279—cited by other.*

(Continued)

*Primary Examiner*—Cuong H Nguyen
(74) *Attorney, Agent, or Firm*—MacMillan, Sobanski & Todd, LLC

(57) ABSTRACT

An operator display system for a material handling vehicle, the material handing vehicle having a material handling device comprising an arm and a material handling implement mounted on the arm, the operator display system being operable to receive input information comprising information relating to the orientation of the arm and of the material handling implement and calculate the position of the material handling implement, the operator display system further having a head-up display, the operator display system being operable to generate an output in accordance with the input information and display the output on the head-up display.

12 Claims, 7 Drawing Sheets

U.S. PATENT DOCUMENTS

| | | | | |
|---|---|---|---|---|
| 6,585,067 | B2 * | 7/2003 | Tsuji | 180/90 |
| 7,159,915 | B2 * | 1/2007 | Corey et al. | 296/24.3 |
| 7,171,295 | B2 * | 1/2007 | Furuno et al. | 701/50 |
| 7,333,922 | B2 * | 2/2008 | Cannon | 702/193 |
| 7,415,126 | B2 * | 8/2008 | Breed et al. | 382/100 |
| 7,446,650 | B2 * | 11/2008 | Scholfield et al. | 340/438 |
| 2003/0028297 | A1 * | 2/2003 | Iihoshi et al. | 701/33 |
| 2004/0145457 | A1 * | 7/2004 | Schofield et al. | 340/425.5 |
| 2005/0256607 | A1 * | 11/2005 | Shepherd et al. | 700/213 |
| 2006/0119572 | A1 * | 6/2006 | Lanier | 345/156 |
| 2006/0286944 | A1 * | 12/2006 | Songwe, Jr. | 455/99 |
| 2008/0007617 | A1 * | 1/2008 | Ritchey | 348/37 |
| 2008/0030573 | A1 * | 2/2008 | Ritchey | 348/36 |
| 2008/0209878 | A1 * | 9/2008 | Farley | 56/10.2 R |

FOREIGN PATENT DOCUMENTS

| | | | |
|---|---|---|---|
| JP | 01312129 | | 12/1989 |
| JP | 06156119 | | 6/1994 |
| JP | 08074296 | | 3/1996 |
| JP | 08319640 | | 12/1996 |
| JP | 09200650 | | 7/1997 |
| JP | 2007182132 | A * | 7/2007 |
| WO | WO 85/03096 | | 7/1985 |
| WO | WO 99/42327 | | 8/1999 |
| WO | WO 01/68504 | | 9/2001 |

OTHER PUBLICATIONS

"Fighter, Helicopter Test Pilots Challenge Cockpit Design Concepts" appearing in Aviation Week & Space Technology, p. 65, dated Nov. 16, 1987—cited by other.*

"New Cockpits User Integrated Electronics", appearing in Aviation Week & Space Technology, p. 148, dated Jan. 16, 1984—cited by other.*

J. W. Groulx, "Advanced Attack Helicopter (YAH-64) Status Report", Source Unknown, predates Dec. 1981—cited by other.*

Section 4-28 of TM 55-1520-238-10, the Apache (AH-64A), "Helicopter Operator's Technical Manual", dated Jun. 28, 1984—cited by other.*

Engineering aspects and applications of the new Raman instrumentationPitt, G.D.; Batchelder, D.N.; Bennett, R.; Bormett, R.W.; Hayward, I.P.; Smith, B.J.E.; Williams, K.P.J.; Yang, Y.Y.; Baldwin, K.J.; Webster, S.; Science, Measurement and Technology, IEE Proceedings—vol. 152, Issue 6, Nov. 4, 2005 pp. 241-318.*

Night Vision: infrared takes to the road; Schreiner, K.; Computer Graphics and Applications, IEEE; vol. 19, Issue 5, Sep.-Oct. 1999 pp. 6-10; Digital Object Identifier 10.1109/38.788791.*

Usability evaluation of a flight-deck airflow hazard visualization system; Aragon, C.R.; Digital Avionics Systems Conference, 2004. DASC 04. The 23rd; vol. 1, Oct. 24-28, 2004 pp. 4.B.2-41-11 vol. 1.*

Using visualization in cockpit decision support systems; Aragon, C.R.; Systems, Man and Cybernetics, 2005 IEEE International Conference on; vol. 3, Oct. 10-12, 2005 pp. 2396-2401 vol. 3; Digital Object Identifier 10.1109/ICSMC.2005.1571507.*

Head Orientation Prediction: Delta Quaternions Versus Quaternions; Himberg, H.; Motai, Y.; Systems, Man, and Cybernetics, Part B: Cybernetics, IEEE Transactions on; vol. PP, Forthcoming, 0 pp. 1-1; Digital Object Identifier 10.1109/TSMCB.2009.2016571.*

A Fastening Tool Tracking System Using an IMU and a Position Sensor With Kalman Filters and a Fuzzy Expert System Won, S.-H.P.; Golnaraghi, F.; Melek, W.W.; Industrial Electronics, IEEE Transactions on; vol. 56, Issue 5, May 2009 pp. 1782-1792; Digital Object Identifier 10.1109/TIE.2008.2010166.*

A Novel Active Heads-Up Display for Driver Assistance; Doshi, A.; Shinko Yuanhsien Cheng; Trivedi, M.M.; Systems, Man, and Cybernetics, Part B: Cybernetics, IEEE Transactions on; vol. 39, Issue 1, Feb. 2009 pp. 85-93; Digital Object Identifier 10.1109/TSMCB.2008.923527.*

Y.-C. Liu and M.-H. Wen, "Comparison of head-up display (HUD) vs. head-down display (HDD): Driving performance of commercial vehicle operators in Taiwan," Int. J. Human-Comput. Studies, vol. 61, No. 5, pp. 679-697, Nov. 2004.*

M. Wittman, M. Kiss, P. Gugg, A. Steffen, M. Fink, E. Poppel, and H. Kamiya, "Effects of display position of a visual in-vehicle task on simulated driving," Appl. Ergon., vol. 37, No. 2, pp. 187-199, Mar. 2006.*

M. M. Trivedi and S. Y. Cheng, "Holistic sensing and active displays for intelligent driver support systems," Computer, vol. 40, No. 5, pp. 60-68, May 2007.*

A. D. Wiles, D. G. Thompson, and D. D. Frantz, "Accuracy assessment and interpretation for optical tracking systems," in Proc. SPIE—Medical Imaging, Visualization, Image-Guided Procedures, Display, 2004, vol. 5367, pp. 421-432.*

M. M. Trivedi, T. Gandhi, and J. McCall, "Looking-in and looking-out of a vehicle: Computer-vision-based enhanced vehicle safety," IEEE Trans. Intell. Transp. Syst., vol. 8, No. 1, pp. 108-120, Mar. 2007.*

A. Doshi and M. M. Trivedi, "A comparative exploration of eye gaze and head motion cues for lane change intent prediction," in Proc. IEEE Intell., Veh. Symp., 2008.*

E. Murphy-Chutorian and M. M. Trivedi, "Head pose estimation in computer vision: A survey," IEEE Trans. Pattern Anal. Mach. Intell., 2008.*

* cited by examiner

OPERATOR DISPLAY SYSTEM

CROSS-REFERENCE TO RELATED APPLICATIONS

Priority is claimed to United Kingdom patent application Serial No. 0410415.4 filed May 11, 2004.

STATEMENT REGARDING FEDERALLY SPONSORED RESEARCH OR DEVELOPMENT

Not Applicable.

TECHNICAL FIELD

This invention relates to an operator display system for a material handling vehicle, and a material handling vehicle provided with an operator display system.

BACKGROUND OF THE INVENTION

In a material handling vehicle, it is conventional for the vehicle to be provided with a multi-part arm where each part of the arm is movable relative either to the vehicle or other parts of the arm by a suitable actuator, conventionally a fluid-operated ram. It is generally the case that each actuator is controlled separately by an operator by operation of an associated valve or control. In general, at least one of the actuators causes pivotal movement of a arm part relative either to the structure of the vehicle itself or to another part of the ann. Consequently, where it is required to move a material handling implement mounted on the arm along a desired path, and in particularly in a generally straight line, a great deal of skill is required on the part of an operator to provide the relative movement between the arm parts and the vehicle such that the material handling implement moves along the desired path. A particular example is in backhoes. Backhoes have at least two arm parts, one of which is pivotally mounted on the vehicle structure and the other arm part which is pivotally mounted on the first arm part In applications such as digging an excavation. it is desirable to move a material handling implement in the form of a bucket provided on the arm in a straight line towards the vehicle to provide an appropriate flat bottom trench, and a great deal of operator skill is required to cause the requisite pivotal movement of the arm parts to cause the bucket to move along its desired path A source of difficulty for the operator is that the operator has to judge by eye the three-dimensional position of the material handling implement arid operate the controls accordingly to move the material handling implement along a desired path. In the example, of a backhoe, the material handling implement may be hidden from the operator's view by the arm, and where the backhoe is being used for an excavation, the base of the trench may also be partly hidden from the driver. It is known to provide a camera on the arm and a television monitor in the cab to enable the operator to, for example, look at the ground underneath the material handling implement to be able to check for obstructions such as buried pipes but this is only of limited assistance in judging the position of the material handling implement and requires the operator to look at a screen and away from the material handling implement itself.

BRIEF SUMMARY OF THE INVENTION

An aim of the present invention is to reduce or overcome the above problem.

According to the first aspect of the invention we provide, an operator display system for a material handling vehicle, the material handing vehicle having a material handling device comprising an arm and a material handling implement mounted on the ann. the operator display system being operable to receive input information relating to at least one of the arm and the material handling implement, the operator display system further having a head-up display, the operator display system being operable to generate an output in accordance with the input information and display the output on the head-up display.

By providing the operator with information relating to the material handling implement position on a head up display, a display giving guidance to the operator may be provided and, by providing the information through a head up display, the operator can still look directly at the material handling implement during operation.

The input information may comprise position information relating to the position of the material handling implement.

The input information may comprise information relating to the orientation of the aim and of the material handling implement and the operator display system may be operable to calculate the position of the material handling implement and generate the output accordingly.

The arm may comprise a plurality of fluid-operated rains arid the input information may comprise information relating to the extension of each fluid-operated rain.

The operator display system may be provided with target information and may be operable to generate the output in accordance with the target information.

The target information may comprise profile information for an excavation and the operator display system may be operable to generate an output in accordance with the position information and the profile information.

The operator display system may be operable to store position information and generate an output in accordance with the stored position information.

The operator display system may be operable to calculate a current excavation profile in accordance with the stored position information and generate an output in accordance with the profile information, the current excavation profile and the position information.

The input information may comprise a video signal and the operator display system may be operable to generate an output comprising an image.

The operator display system may comprise a projector operable to generate an image on a window of the vehicle to provide the head up display.

The operator display system may comprise a projector operable to generate an image on a visor to be worn by an operator to provide the head up display.

According to a second aspect of the invention we provide a material handling vehicle comprising a material handling device having an arm and a material handling implement provided on the arm, the vehicle further comprising an operator display system and a sensing element associated with at least one of the arm and the material handling implement to generate input information, wherein the operator display system comprises an operator display system according to any one of the preceding claims.

The arm may comprise a plurality of fluid-operated rams and a sensing element may be associated with each ram to generate input information comprising information relating to the extension of each fluid-operated rain.

The arm may be provided with a camera to generate input information comprising a video signal and the operator display system may be operable to generate an output comprising an image.

BRIEF DESCRIPTION OF THE DRAWINGS

The invention will now be described by way of example only with reference to the accompanying drawings wherein.

DETAILED DESCRIPTION OF THE INVENTION

Figure 1:
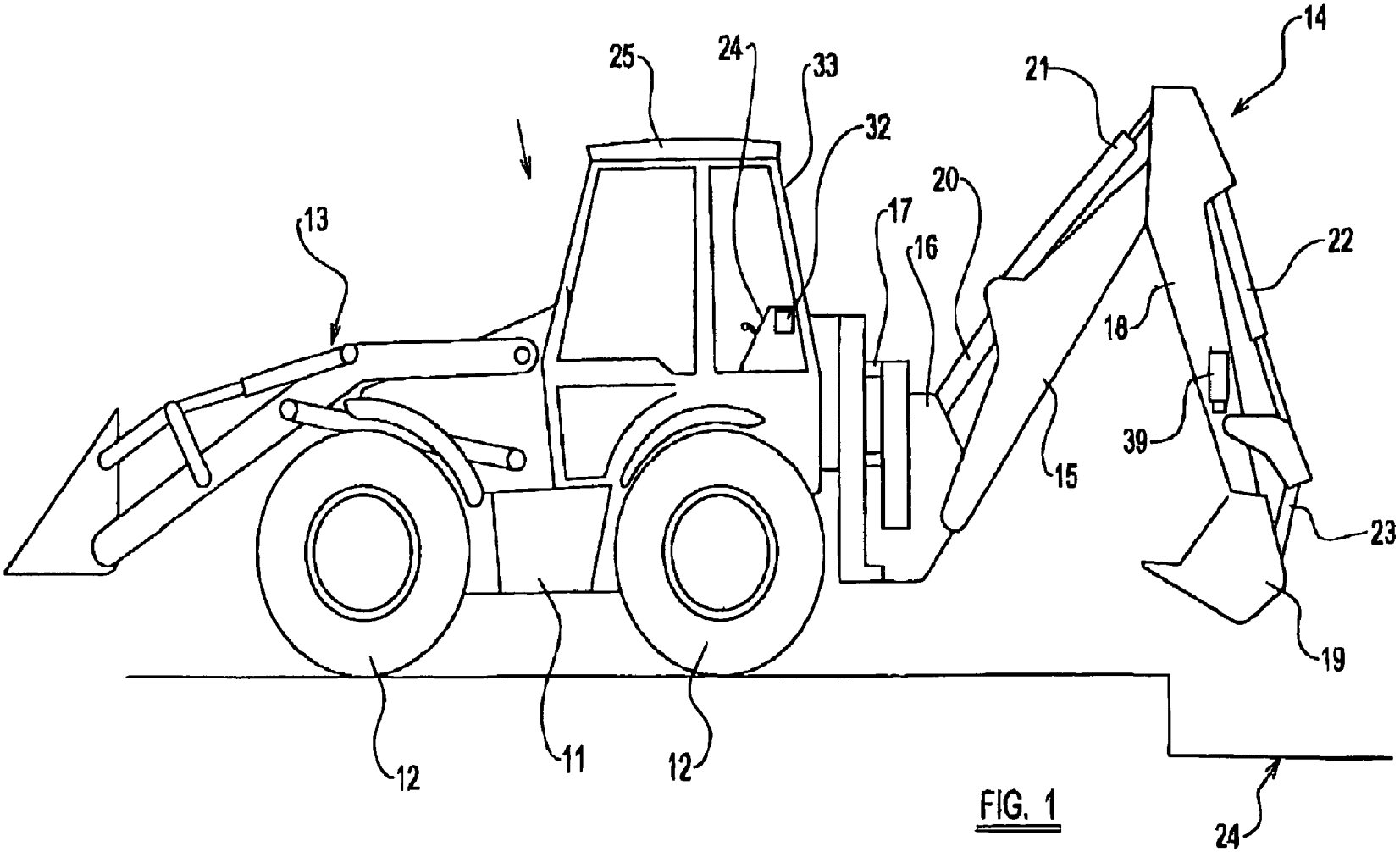
FIG. 1 is a side view of a material handling implement embodying the present invention.

Referring now to FIG. 1, a material handling vehicle is shown at 10, in this example comprising a back hoe loader. The vehicle 10 comprises a structure 11 provided with ground engageable propulsion means, in this example wheels 12. The vehicle 10 is provided with a front loader 13 and a material handling device 14 comprising a backhoe, The material handling device 14 comprises a first arm part 15 pivotally mounted to the structure 11 via a king post assembly 16 of known type for pivotal movement about horizontal and vertical axes relative to the structure 11, and also for sliding sideways movement on a slide 17 in conventional manner. The material handling device 14 further comprises a second arm part 18 which is pivotally mounted on the first arm part 15. A material handling implement comprising a bucket 19 is pivotally mounted on the second arm part 18.

To provide vertical swinging movement, about a horizontal axis of the first arm part 15, a first actuator 20 comprising a fluid operated ram is mounted between the first arm part 15 and the king post assembly 16. To provide pivotal movement of the second arm part 18 relative to the first arm part 15, a second actuator 21 comprising a fluid operated ram is connected between the first arm part 15 and the second arm part 18. To provide for pivotal movement of the bucket 19 relative to the second arm part 18, a further actuator comprising a fluid operated ram 22 is provided between the second arm part 18 and a link assembly generally shown at 23 connected to the bucket 19, The actuators 20, 21, 22 are operated from a control panel shown at 24 provided in an operator's cab 20 of the vehicle 10.

Figure 2:
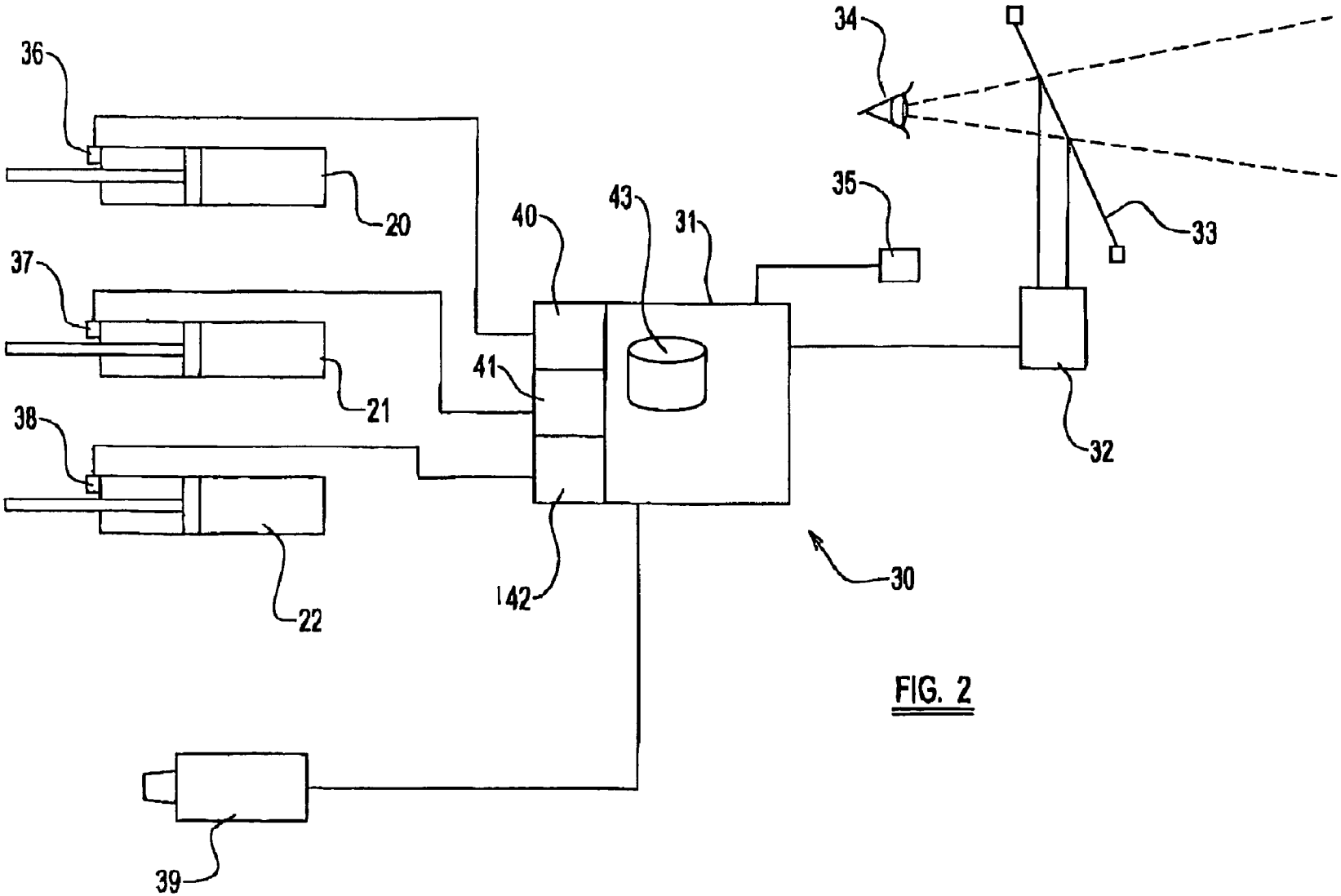
FIG. 2 is a diagrammatic illustration of an operator display system embodying the present invention.

The vehicle in FIG. 1 is provided with an operator display system as generally illustrated at 30 in FIG. 2 The operator display system 30 has a controller 31 operable to generate an output and a projector 32 which is operable to display the output as an image, in the present example by projecting a display on a rear windscreen 33 of the vehicle 10. When viewed by an operator as diagrammatically illustrated at 34, the image appears to be external to the vehicle overlaid on whatever the operator is looking at, as is known from other head up display systems. The image appears in this example to be about 2 meters away so that the operator can look at the material handling device 14 and view the image without having to refocus his eyes. The system 30 is controllable by the operator through a control 35, for example to vary the display or turn the operator display system 30 on or off.

The controller 31 is operable to receive input information relating to at least one of the arm 14 and the material handling implement 19, and generate an output in accordance with the display information. In the present example, the vehicle is provided with a plurality of sensing means 36, 37, 38 associated with each of the fluid-operated rams 20, 21, 22. The vehicle is also provided with a camera 39 mounted on the second arm part 18 to provide information comprising a video signal to the controller 31.

In the present example, the signals from the sensors 36, 37, 38 are passed to decoders 40, 41, 42 to calculate the extension of each fluid-operated rain 20, 21, 22. From this information, the controller 31 is operable to calculate the position of the material handling implement 19, from the orientation of the arm parts and of the material handling implement 19. The controller 31 may for example calculate the location of the tips of the teeth where the material handling implement 19 comprises a bucket. An output is then generated in accordance with the calculated position information and an image provided by the projector 32 It will be apparent that the position information may be made available to an operator of the vehicle 10 in any appropriate manner which may be desirable In particular, the controller 31 may be provided with a memory shown at 43 on which may be stored target information relating to the desired operation of the material handling device 14. In the present example, where the material handling device 14 is a backhoe to be used to carry out an excavation such as digging a trench, the target information may comprise profile information corresponding to the desired dimensions of the excavation. An output may be generated by the controller 31 and provided as an image to the operator 34 as desired.

Referring now to FIGS. 3 to 6, four examples of a view presented to an operator are shown. The operator is facing the rear windscreen 33 and is able to view the operation of the material handling device 14 and in particular the material handling implement 19, and view the excavation 44. The projector 32 is located to project an image on to the rear windscreen 33 such that an image as shown at 45 is displayed to the operator at an apparent distance of 2 meters. The display may be projected on to a prepared area of the windscreen 33 as shown at 46, or if the rear windscreen 33 is suitable may be projected anywhere on the rear windscreen 33 as desired in accordance with the function and current use of the material handling vehicle 10 and material handling device 14.

Figure 3:
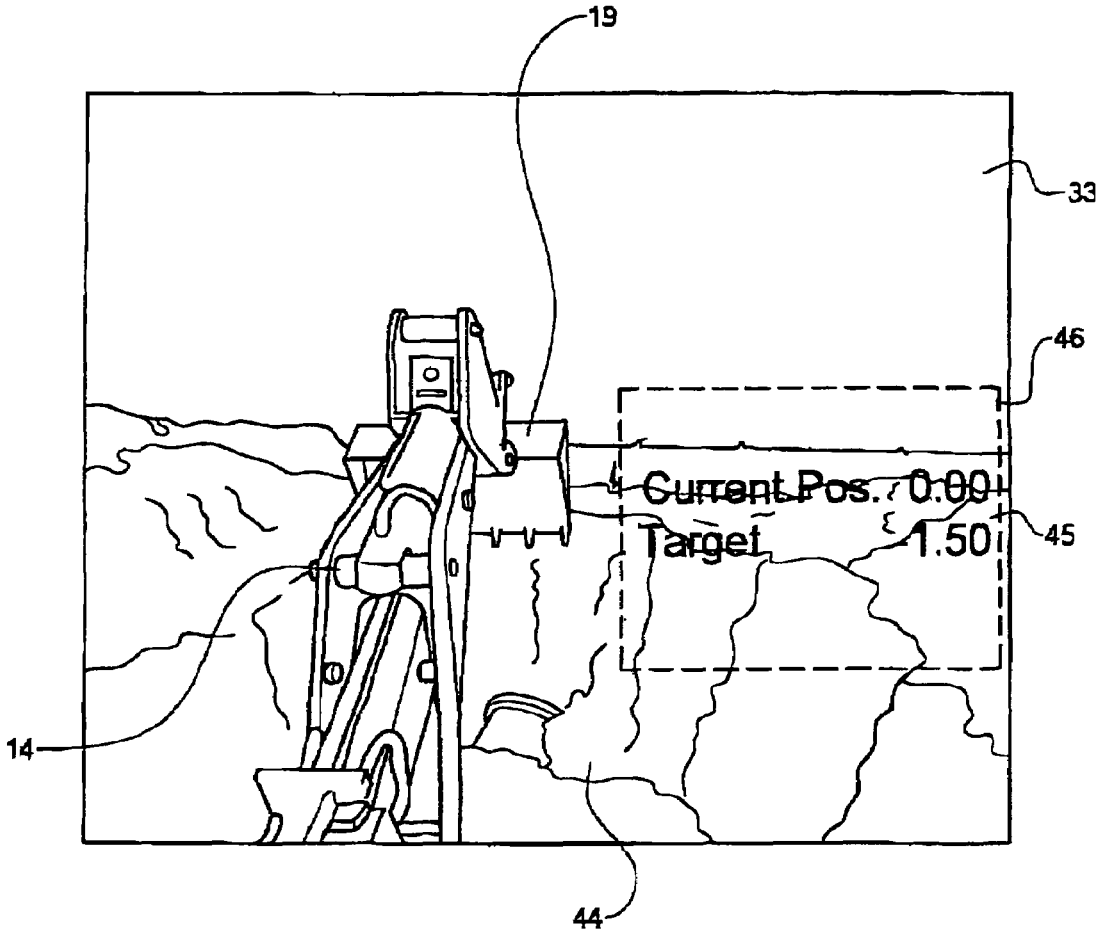
FIG. 3 is an example of the view presented to an operator of the material handling vehicle of FIG. 1.
Figure 4:
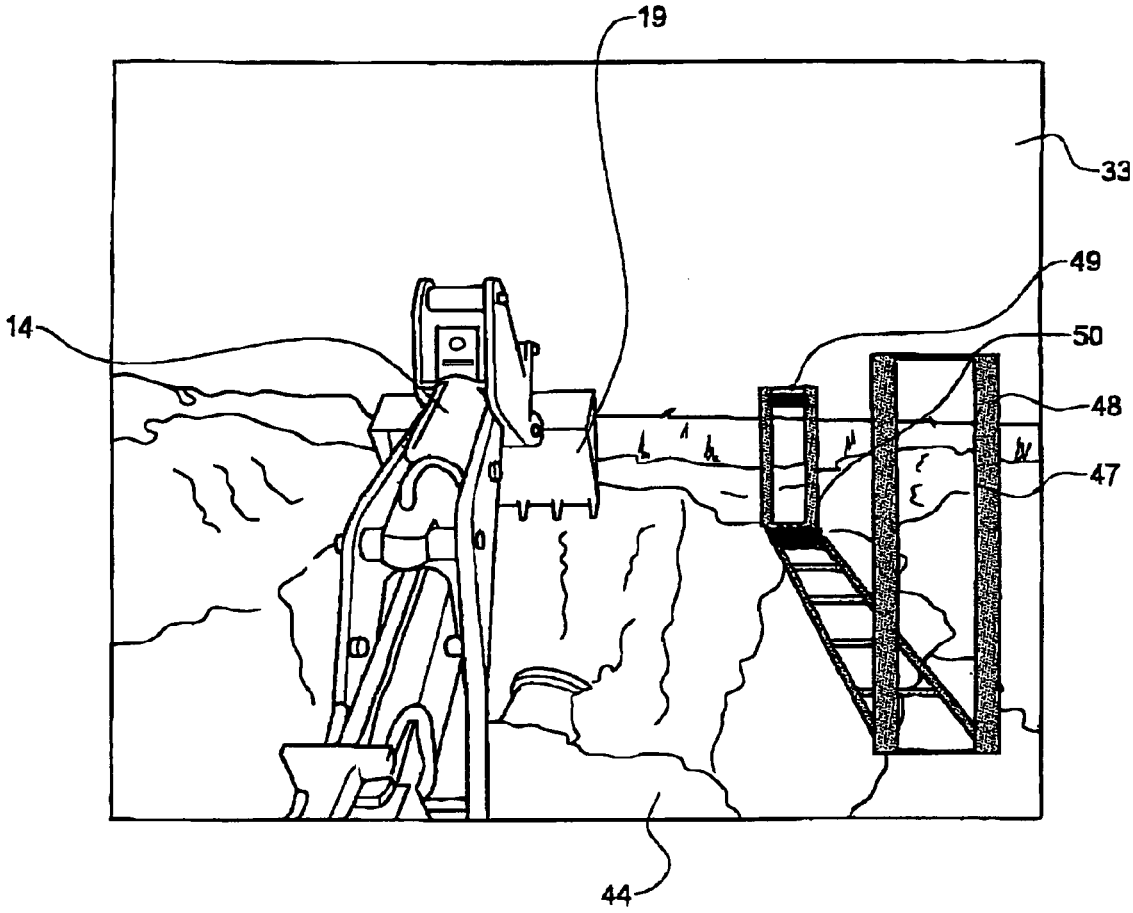
FIG. 4 is a second example of a view presented to an operator.

In the example of FIG. 3, the image 45 consists simply of a current position for the material handling implement 19, for example height relative to ground level, and a target depth for the excavation at that extension of the arm 14. A more intuitive display is shown at 47 in FIG. 4, wherein accordance with the stored profile information a perspective outline of the excavation is shown at 48, with the x and y positions of the material handling implement 19 shown as bars 49, 50 on, the trench outline 48. The bars 49 and 50 could of course be combined into a single indicator matching the position of the material handling implement 19 as desired. The image 47 is displayed such that it appears to the operator alongside the arm 14 and excavation 44 so that it provides a guide to the excavation 44 without obscuring the operator's view of the arm 14 and material handling implement 19.

Figure 5:
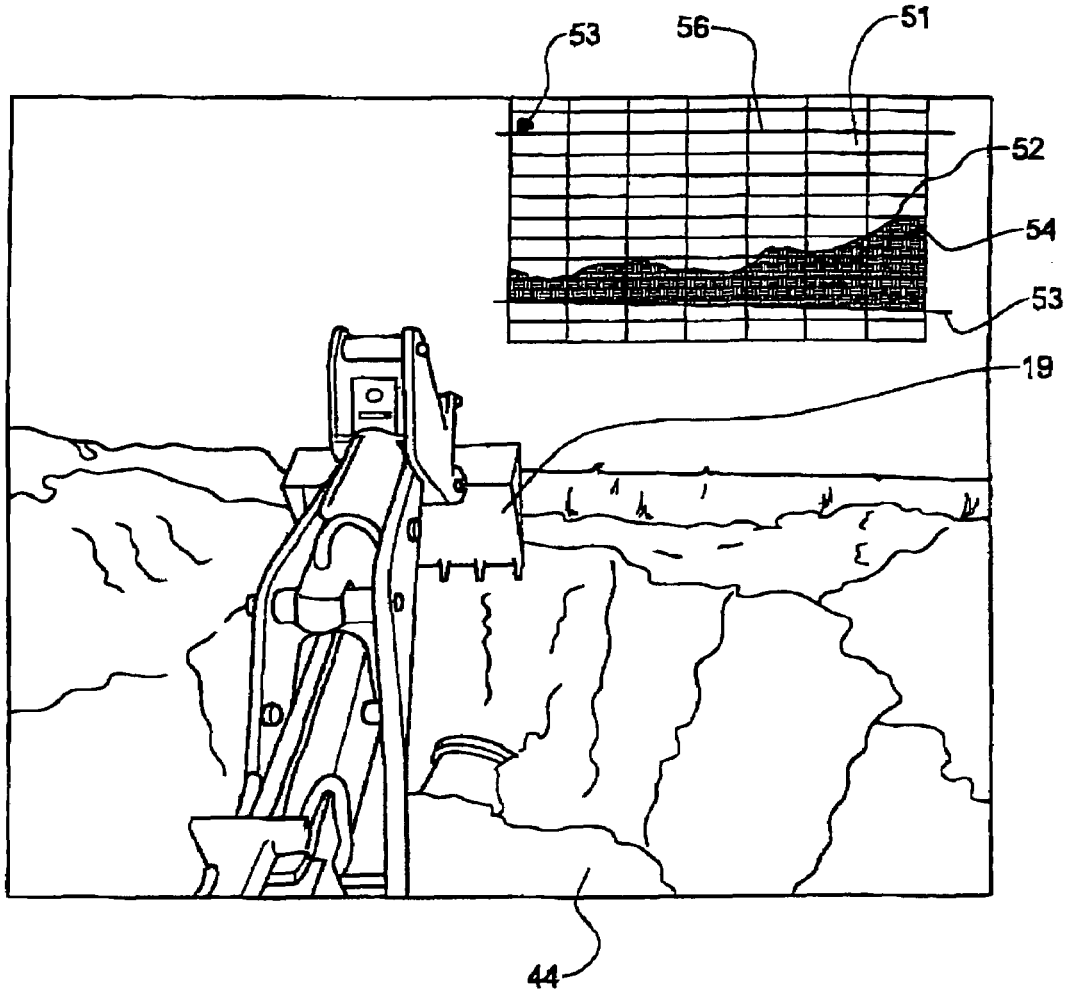
FIG. 5 is a third example of a view presented to an operator.

The controller 31 may also be operable to store the calculated position information in the memory 43, such that the controller 31 can generate an output in accordance with past positions of the material handling implement 19 These may be used to, for example, generate a display showing a path of travel of the material handling implement 19 or any other part of the arm 14. In the example of FIG. 5, this stored position information is used to generate an excavation profile by taking the lowest point reached by the material handling implement 19 at each longitudinal position along the trench to provide an excavation profile, thus indicating to an operator what still needs to be done on the excavation 44. Thus, in FIG. 5 the image 51 comprises an excavation profile 52 including a desired base 53 of the excavation 44. The calculated current excavation profile is shown as the varying surface 54, and the position information showing the current position of the material handling implement 19 is shown at 55. In this example, the ground level is represented by a line 56. This thus presents the operator a simple and intuitive display of the current position of the material handling implement 19 and where it is in relation to the desired excavation and what remains to be dug out.

Figure 6:
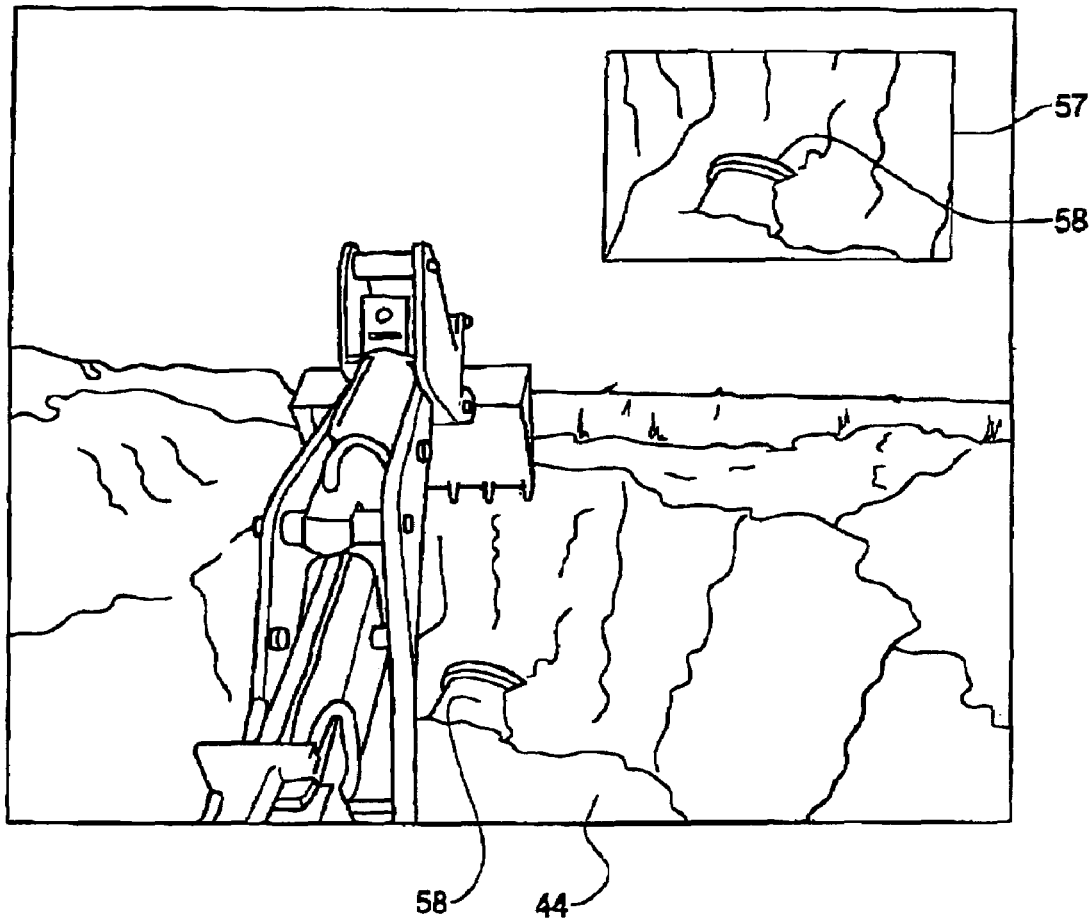
FIG. 6 is a fourth example of a view presented to an operator.

As illustrated in FIG. 6, the image from a video camera 39 may also be used to generate an output which is projected onto the rear windscreen 33 as an image 57 This would be useful where, for example, an obstacle comprising a buried pipe 58 is present in the desired excavation 44 and allows the operator to view the obstacle from the cab 25. The operator can switch between different types of image using the control generally shown at 35.

The position of the fluid actuated rams 20, 21, 22 may be provided by any appropriate sensing apparatus, such as that shown in our co-pending application. The decoders 40, 41, 42 may also be provided separately from the controller 31 and may be provided as a single decoder operable to calculate each extension, and possibly, calculate position information as required.

Figure 7:
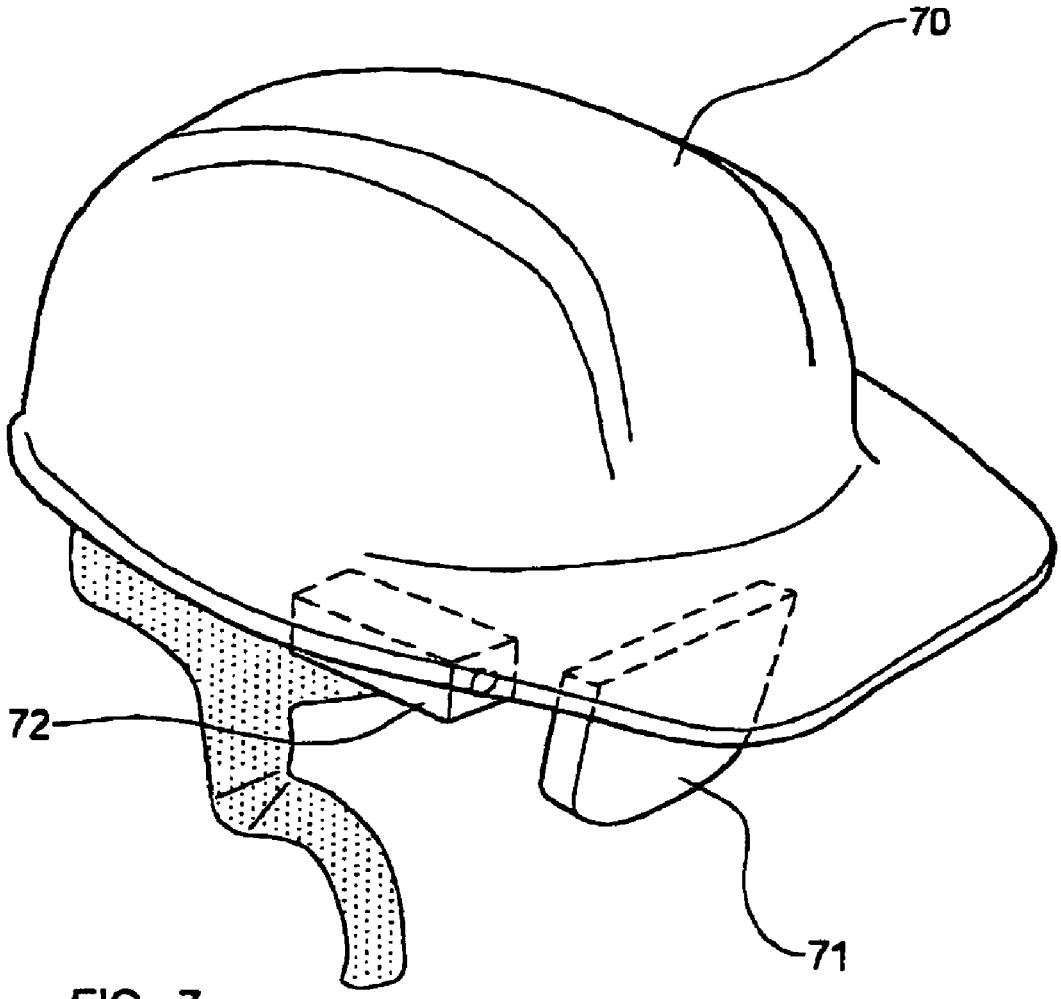
FIG. 7 is a diagrammatic illustration of a hat provided with a display for an operator display system of FIG. 2.

It is envisaged that the display need not be provided on a windscreen 33 of the vehicle 10. The display may be provided elsewhere on a suspended or otherwise supported transparent screen viewable by an operator, for example, if the vehicle does not have a windscreen or other window or if the windscreen or other window is inappropriately shaped or located or is otherwise unsuitable, As a further example, at FIG. 7, a safety helmet 70 to be worn by an operator is shown provided with a screen in the form of a visor 71, and a projector 72 to generate an image on the visor 71 such that the image appears to the operator to be located at an appropriate distance from him, for example, 2 meters as in the previous example. The projector 72 may communicate with the controller 71 by any appropriate means as desired, for example by a short range radio frequency connection.

The invention as described herein thus does not interfere with a normal vision of an operator, provides the operator with an additional choice of views and information. The position information thus permits an operator to operate a material handling device with increased accuracy and improved safety.

Although the material handling vehicle shown herein, is a backhoe, the term "material handling vehicle" may refer to any appropriate type of vehicle such as a telehandler, a loading shovel, a mini excavator, a rotary excavator, a agricultural vehicle such as a tractor or otherwise, and may be tracked/or wheeled, provided with convention skid steering and have any appropriate configuration as desired.

In the present specification "comprise" means "includes or consists of" and "comprising" means "including or consisting of".

The features disclosed in the foregoing description, or the following claims, or the accompanying drawings, expressed in their specific forms or in terms of a means for performing the disclosed function, or a method or process for attaining the disclosed result, as appropriate. may, separately, or in any combination of such features, be utilized for realizing the invention in diverse forms thereof.

The invention claimed is:

1. An operator display system for a material handling vehicle, the material handing vehicle having a material handling device comprising an arm and a material handling implement mounted on the arm, the operator display system being operable to receive input information comprising information relating to the orientation of the arm and of the material handling implement and calculate the position of the material handling implement, the operator display system being operable to store position information for the material handling implement;

the operator display system further having a head-up display, the operator display system being operable to generate an output in accordance with the input information and the stored position information and display the output on the head-up display.

2. An operator display system according to claim 1 wherein the output comprises an indication of the position of the material handling implement.

3. An operator display system according to claim 1 wherein the arm comprises a plurality of fluid-operated arms and wherein the input information comprises information relating to the extension of each fluid-operated rain.

4. An operator display system according to any claim 1 wherein the operator display system is provided with target information and is operable to generate the output in accordance with the target information.

5. An operator display system according to claim 4 wherein the target information comprises profile information for an excavation and wherein the operator display system is operable to generate an output in accordance with the position information and the profile information.

6. A material handling vehicle comprising a material handling device having an arm and a material handling implement provided on the arm, the vehicle further comprising an operator display system and a sensing element associated with at least one of the arm and the material handling implement to generate input information, the operator display system being operable to receive input information comprising information relating to the orientation of the arm and of the material handling implement from the sensing element and calculate the position of the material handling implement, the operator display system being operable to store position information for the material handling implement, the operator display system further having a head-up display, the operator display system being operable to generate an output in accordance with the input information and the stored position information and display the output on the head-up display.

7. An operator display system according to claim 1 wherein the operator display system is provided with target information and is operable to generate the output in accordance with the target information, wherein the target information comprises profile information for an excavation and wherein the operator display system is operable to generate an output in accordance with the position information and the profile information, and wherein the operator display system is operable to calculate a current excavation profile in accordance with the stored position information and generate an output in accordance with the profile information, the current excavation profile arid the position information.

8. An operator display system according to claim 1 wherein the input information comprises a video signal and the operator display system is operable to generate an output comprising an image.

9. An operator display system according to claim 1 comprising a projector operable to generate an image on a window of the vehicle to provide the head up display.

10. An operator display system according to claim 1 comprising a projector operable to generate an image on a visor to be worn by an operator to provide the head up display.

11. A material handling vehicle according to claim 6 wherein the arm comprises a plurality of fluid-operated rams and wherein a sensing element is associated with each ram to generate input information comprising information relating to the extension of each fluid-operated ram.

12. A material handling vehicle according to claim 11 wherein the arm is provided with a camera to generate input information comprising a video signal and the operator display system is operable to generate an output comprising an image.

* * * * *

UNITED STATES PATENT AND TRADEMARK OFFICE

CERTIFICATE OF CORRECTION

PATENT NO. : 7,606,648 B2
APPLICATION NO. : 11/125936
DATED : October 20, 2009
INVENTOR(S) : Shepherd et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1155 days.

Signed and Sealed this

Twelfth Day of October, 2010

David J. Kappos

David J. Kappos
*Director of the United States Patent and Trademark Office*